US005811212A

United States Patent [19]

Tanaka

[11] Patent Number: 5,811,212

[45] Date of Patent: Sep. 22, 1998

[54] ELECTROPHOTOGRAPHIC PHOTOSENSITIVE MEMBER CONTAINING AN AZOCALIX[N]ARENE COMPOUND AND ELECTROPHOTOGRAPHIC APPARATUS AND PROCESS CARTRIDGE COMPRISING THE PHOTOSENSITIVE MEMBER

[75] Inventor: Masato Tanaka, Shizuoka-ku, Japan

[73] Assignee: Canon Kabushiki Kaisha, Tokyo, Japan

[21] Appl. No.: 845,377

[22] Filed: Apr. 24, 1997

[30] Foreign Application Priority Data

Apr. 26, 1996 [JP] Japan ..... 8-129287

[51] Int. Cl.[6] ..... G03G 5/06

[52] U.S. Cl. ..... 430/58; 430/56; 430/77; 430/78; 399/116; 399/159

[58] Field of Search ..... 430/56, 58, 72, 430/78; 399/159, 116

[56] References Cited

U.S. PATENT DOCUMENTS

| | | | |
|---|---|---|---|
| 3,984,378 | 10/1976 | Kubota et al. | 430/72 |
| 5,434,208 | 7/1995 | Batelaan et al. | 524/288 |

FOREIGN PATENT DOCUMENTS

| | | |
|---|---|---|
| 54-22834 | 2/1979 | Japan . |
| 58-177955 | 10/1983 | Japan . |
| 58-194035 | 11/1983 | Japan . |
| 61-215556 | 9/1986 | Japan . |
| 61-241763 | 10/1986 | Japan . |
| 63-17456 | 1/1988 | Japan . |
| 9-80779 | 3/1997 | Japan . |
| WO93-12428 | 6/1993 | WIPO . |

OTHER PUBLICATIONS

INPADOC AN 26497774.

Patent Abstracts of Japan, vol.14, No. 342, Jul. 1990 for JP–A–02–124863.

*Primary Examiner*—Christopher D. Rodee

*Attorney, Agent, or Firm*—Fitzpatrick, Cella, Harper & Scinto

[57] ABSTRACT

The present invention provides an electrophotographic photosensitive member containing an azo-calix [n] arene compound produced by coupling a calix [n] arene compound and an azonium compound having at least two azo groups. The present invention also provides an electrophotographic apparatus and a process cartridge each produced with the electrophotographic photosensitive member.

11 Claims, 2 Drawing Sheets

ELECTROPHOTOGRAPHIC PHOTOSENSITIVE MEMBER CONTAINING AN AZOCALIX[N]ARENE COMPOUND AND ELECTROPHOTOGRAPHIC APPARATUS AND PROCESS CARTRIDGE COMPRISING THE PHOTOSENSITIVE MEMBER

BACKGROUND OF THE INVENTION

1. Field of the Invention

The present invention relates to an electrophotographic photosensitive member and an electrophotographic apparatus and a process cartridge each comprising the photosensitive member.

2. Related Background Art

Conventionally, inorganic photoconductive materials such as selenium, cadmium sulfide, zinc oxide and the like have widely been used for electrophotographic photosensitive members. On the other hand, electrophotographic photosensitive members comprising an organic photoconductive material have been known, for example, a photosensitive member comprising a photoconductive polymer such as poly-N-vinylcarbazole, a photosensitive member comprising a low-molecular organic photoconductive material such as 2,5-bis(p-diethylaminophenyl)-1,3,4-oxadiazole, a photosensitive member comprising a combination of such an organic photoconductive material and one of various dyes and pigments, etc.

Since the electrophotographic photosensitive member comprising an organic photoconductive material has good film forming properties and can be produced by coating, it has the advantage that the electrophotographic photosensitive member can be produced with high productivity at low cost. Such an electrophotographic photosensitive member also has the advantage that the photosensitive wavelength region can freely be controlled by selecting the dye or pigment used, and thus it has widely been investigated. Particularly, a function separation type photosensitive member comprising a laminate of a charge generating layer containing an organic photoconductive dye or pigment, and a charge transfer layer containing a photoconductive polymer or a low-molecular organic photoconductive material has recently been developed, and thus sensitivity and durability which have been considered as drawbacks of conventional organic electrophotographic photosensitive members have significantly been improved.

Since azo pigments which are known as organic photoconductive materials exhibit excellent photoconductivity, and various kinds of azo pigments can easily be obtained by combining an azo component and a coupler component, many kinds of azo pigments have been proposed so far, as disclosed in Japanese Patent Unexamined Publication Nos. 54-22834, 58-177955, 58-194035, 61-215556, 61-241763, 63-17456, etc.

However, a conventional electrophotographic photosensitive member comprising an azo pigment is not satisfactory in sensitivity and potential stability during repeated use.

SUMMARY OF THE INVENTION

Accordingly, an object of the present invention is to provide an electrophotographic photosensitive member having high sensitivity and stable electric potential during repeated use, and an electrophotographic apparatus and a process cartridge each comprising the photosensitive member.

In accordance with an embodiment of the present invention, an electrophotographic photosensitive member comprises at least a photosensitive layer formed on a substrate, wherein the photosensitive layer contains an azo-calix [n] arene compound produced by coupling a calix [n] arene compound and an azonium compound having at least two azo groups.

In accordance with another embodiment of the present invention, an electrophotographic apparatus comprises the electrophotographic photosensitive member, charging means for charging the electrophotographic photosensitive member, image exposure means for effecting image-exposure to the electrophotographic photosensitive member to form an electrostatic latent image, and development means for developing the electrostatic latent image formed on the electrophotographic photosensitive member with a toner.

In accordance with a further embodiment of the present invention, a process cartridge comprises the electrophotographic photosensitive member, and a charging member for charging the electrophotographic photosensitive member.

DETAILED DESCRIPTION OF THE INVENTION

Figure 1:
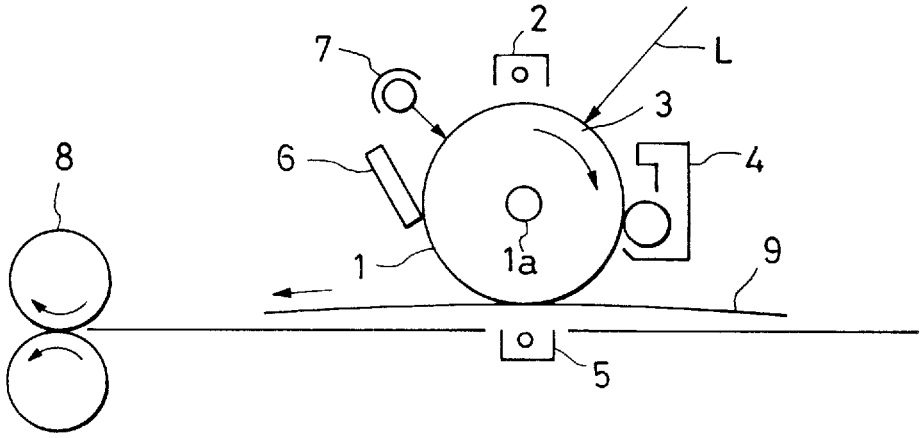
FIG. 1 is a drawing illustrating an example of an electrophotographic apparatus of the present invention.

An electrophotographic photosensitive member of the present invention comprises at least a photosensitive layer formed on a substrate, the photosensitive layer containing an azo-calix [n] arene compound produced by coupling a calix [n] arene compound and an azonium compound having at least two azo groups.

The calix [n] arene compound is preferably represented by the following formula (1):

(1)

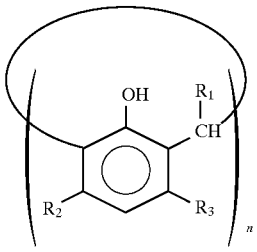

wherein $R_1$, $R_2$ and $R_3$ each is a hydrogen atom or an alkyl group, and n is a positive integer of 4 to 8.

The alkyl group is preferably a $C_1$ to $C_3$ alkyl group which includes a methyl group, an ethyl group or a propyl group.

The azonium compound having at least two azo groups is preferably represented by the following formula (2):

$$Ar-(N_2 \cdot X)_m \quad (2)$$

wherein Ar is an aromatic hydrocarbon ring which is substituted or unsubstituted, a heterocyclic ring which is substituted or unsubstituted, a combination of a plurality of aromatic hydrocarbon rings or a combination of a plurality of heterocyclic rings, X is $BF_4$, $ZnCl_2$ or a halogen atom, and m is a positive integer of 2 to 4.

Preferable examples of the aromatic hydrocarbon rings or heterocyclic rings include aromatic hydrocarbon rings such as benzene, naphthalene, fluorene, phenanthrene, anthracene, fluoranthene, pyrene, and the like; aromatic heterocyclic rings such as furan, thiophene, pyridine, indole, benzothiazole, carbazole, benzocarbazole, acridone, dibenzothiophene, benzoxazole, benzotriazole, oxathiazole, thiazole, phenazine, cinnoline, benzocinnoline, and the like.

Ar is preferably a plurality of aromatic hydrocarbon rings or heterocyclic rings which are combined with each other by aromatic or non-aromatic bonding groups or directly. Examples of Ar having a plurality of aromatic hydrocarbon rings or heterocyclic rings include triphenylamine, diphenylamine, N-methyldiphenylamine, biphenyl, terphenyl, binaphthyl, fluorenone, phenanthrenequinone, anthraquinone, benzanthrone, diphenyloxazole, phenylbenzoxazole, diphenylmethane, diphenyl sulfone, diphenyl ether, benzophenone, stilbene, distyrylbenzene, tetraphenyl-p-phenylenediamine, tetraphenylbenzidine, and the like.

Examples of substituents for the Ar aromatic or heterocyclic rings include alkyl groups such as methyl, ethyl, propyl, butyl, and the like; alkoxy groups such as methoxy, ethoxy, and the like; dialkylamino groups such as dimethylamino, diethylamino, and the like; halogen atoms such as a fluorine atom, a chlorine atom, a bromine atom, and the like; a hydroxyl group; a nitro group; a cyano group; a halomethyl group; and the like.

Examples of halogen atoms represented by X include a fluorine atom, a chlorine atom, a bromine atom, and a iodine atom.

The azo-calix [n] arene compound contained in the electrophotographic photosensitive member of the present invention is preferably the coupling product of a calix [n] arene compound represented by the above formula (1) and an azonium compound represented by the above formula (2). The azo-calix [n] arene compound is preferably represented by the following formula (3):

(3)

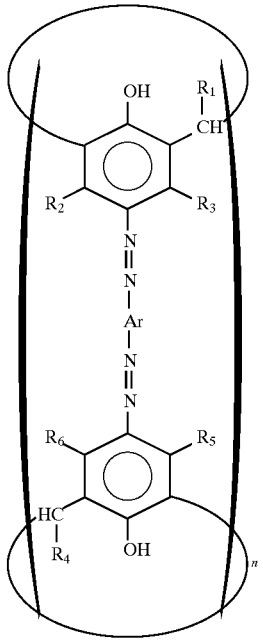

wherein $R_1$, to $R_3$ and n are the same as $R_1$ to $R_3$ and n of formula (1), and $R_4$ to $R_6$ are each a hydrogen atom or an alkyl group which is preferably a methyl group, an ethyl group or a propyl group.

Preferable examples of the azo-calix [n] arene compound used in the present invention are given below. In the examples below, Compound Examples (1) to (15) illustrate compounds represented by the above formula (3) and are shown by reference to Ar, $R_1$, to $R_6$ and n only.

$R_1$–$R_6$: —H

Compound example (1)

Ar:

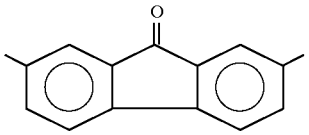

n: 4

$R_1$–$R_6$: —H

Compound example (2)

Ar:

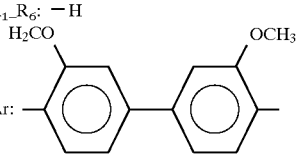

n: 4

$R_1$–$R_6$: —H

Compound example (3)

Ar:

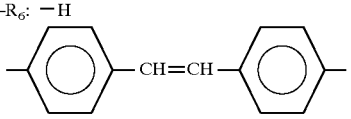

n: 4

$R_1$–$R_6$: —H

Compound example (4)

Ar:

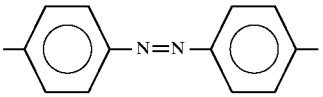

n: 4

$R_1$–$R_6$: —H

Compound example (5)

-continued
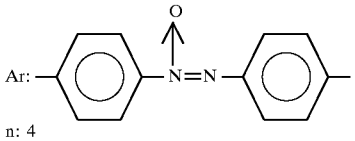
n: 4
$R_1$, $R_4$: —, $R_2$, $R_3$, $R_5$, $R_6$: $-CH_3$ Compound example (6)
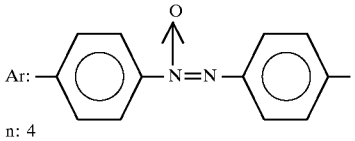
n: 4
$R_1$, $R_4$: $-CH_3$, $R_2$, $R_3$, $R_5$, $R_6$: —H Compound example (7)
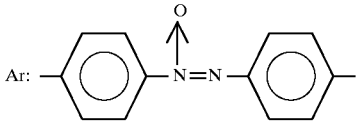
n: 4
$R_1$–$R_6$: —H Compound example (8)
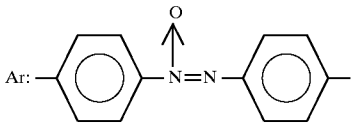
n: 5
$R_1$–$R_6$: —H Compound example (9)
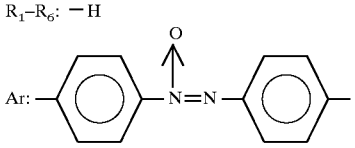
n: 6
$R_1$–$R_6$: —H Compound example (10)
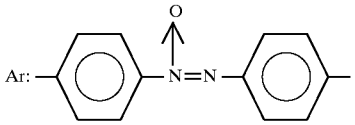
n: 7
$R_1$–$R_6$: —H Compound example (11)
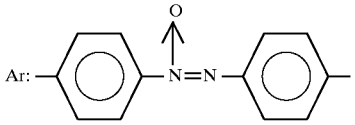
n: 8
$R_1$–$R_6$: —H Compound example (12)
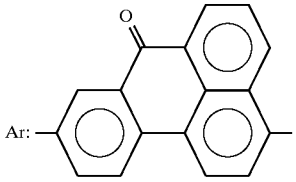
n: 4
$R_1$–$R_6$: —H Compound example (13)
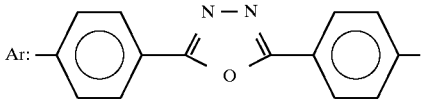
n: 6
$R_1$–$R_6$: —H Compound example (14)

-continued
Ar: 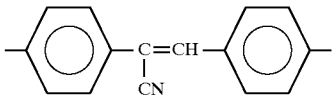
n: 4
$R_1$–$R_6$: —H
Compound example (15)
Ar: 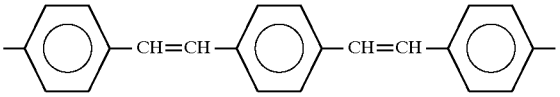
n: 4
Compound example (16)
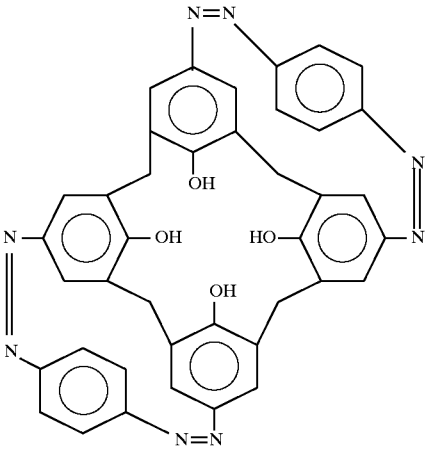
Compound example (17)
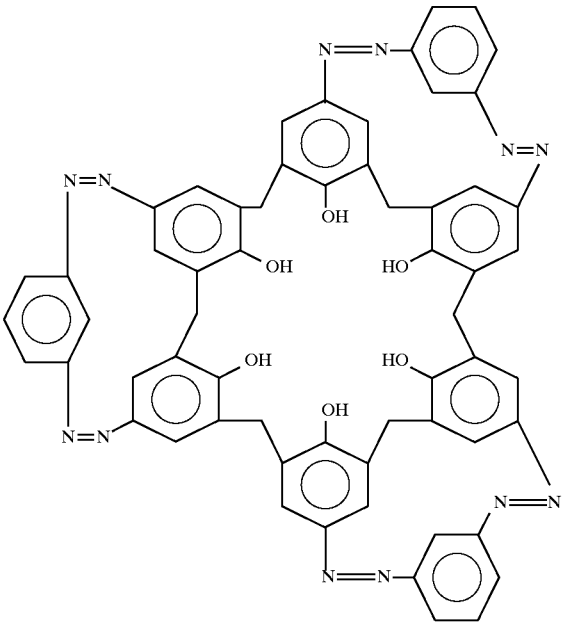

-continued
Compound example (18)
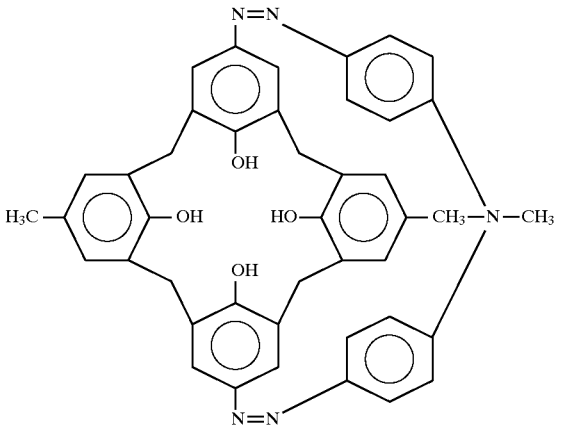
Compound example (19)
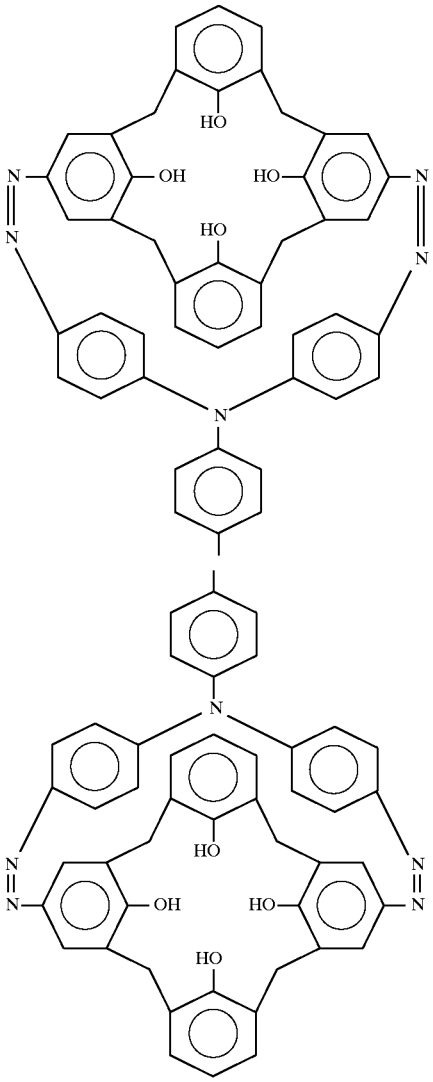

-continued
Compound example (20)
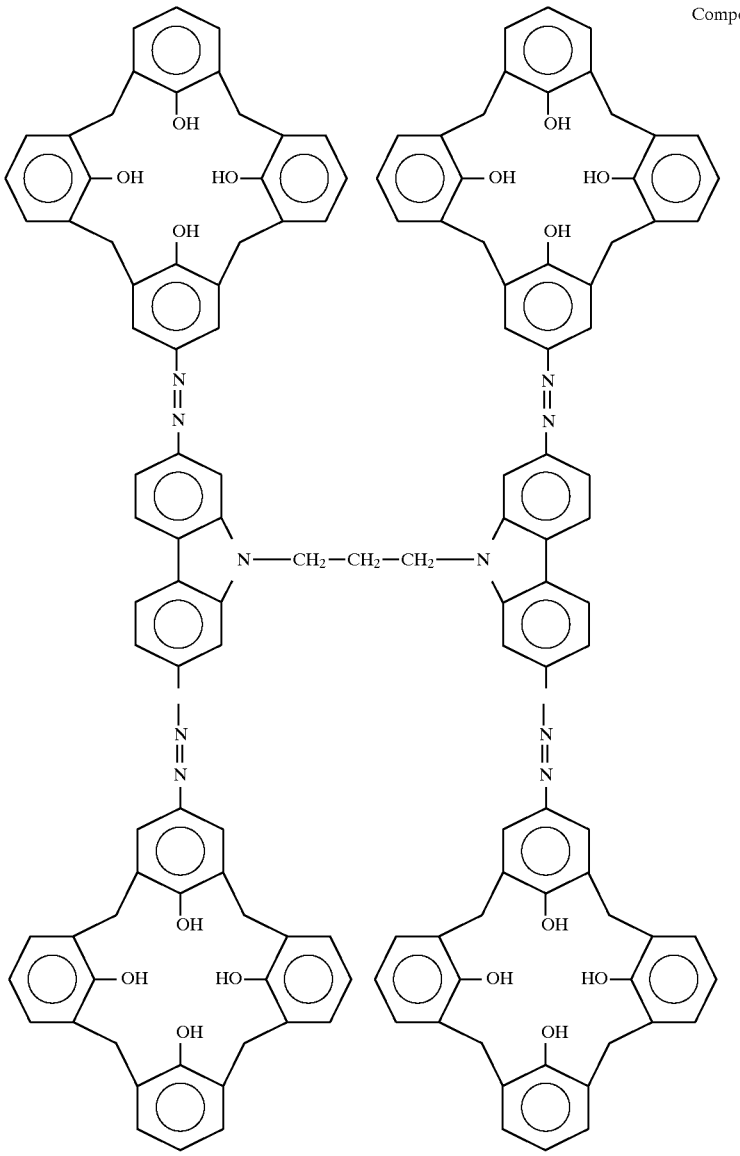

-continued
Compound example (21)
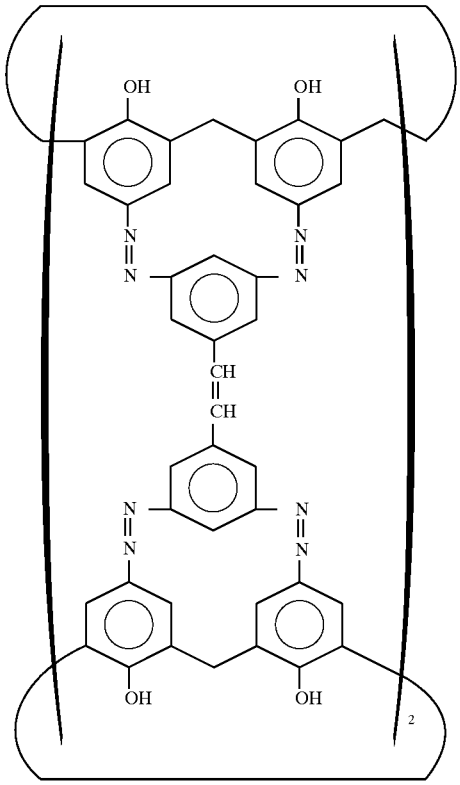
Compound example (22)
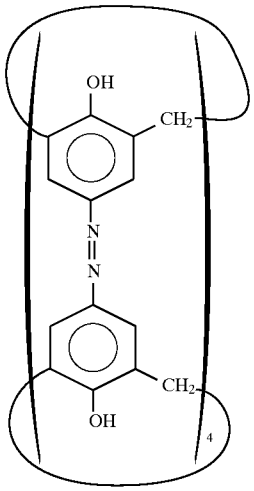
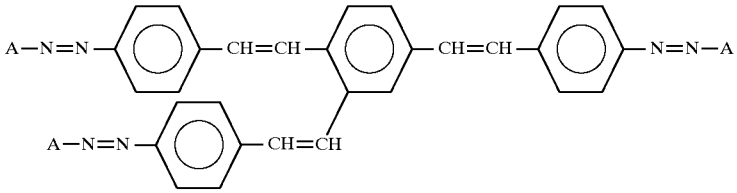

-continued
Compound example (23)
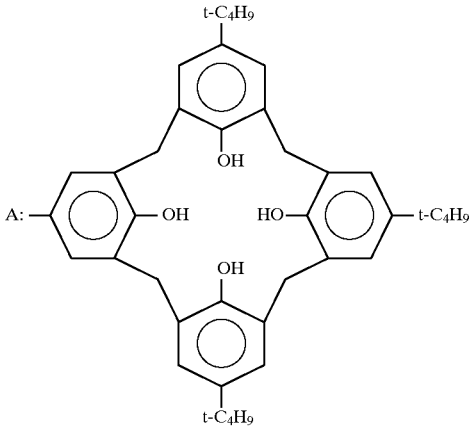
Compound example (24)
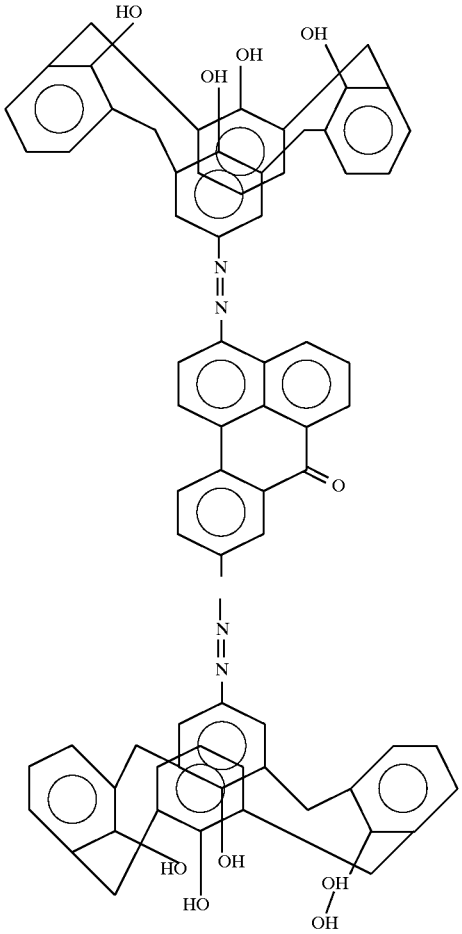

-continued

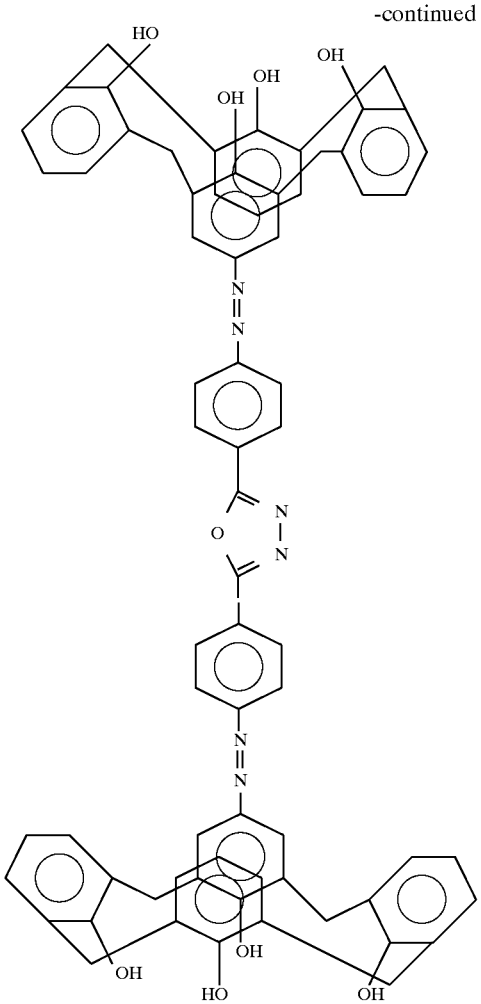

Compound (25)

The azo-calix [n] arene compound used in the present invention can easily be synthesized by forming a tetrazo-compound of amine by a general method and then coupling with calix [n] arene in the presence of an alkali in an aqueous system or converting an azonium salt to a borofluoride or zinc chloride double salt and then coupling with calix [n] arene in the presence of a base such as sodium acetate, triethylamine, pyridine, N-methylformamide or the like in an organic solvent such as N, N-dimethylformamide, dimethylsulfoxide or tetrahydrofuran.

Synthetic Example (Synthesis of Compound Example (1))

75 ml of water, 15 ml of conc. hydrochloric acid and 10.5 g (0.05 mol) of 2,7-diaminofluorenone were poured into a 300-ml beaker, and then cooled to 0° C. A solution prepared by dissolving 7.6 g (0.11 mol) of sodium nitrite in 17 g of water was added dropwise to the resultant solution over 10 minutes while maintaining the solution temperature at 5° C. or less. After agitation for 20 minutes, the solution was filtered with carbon, and a solution prepared by dissolving 19.8 g (0.18 mol) of sodium borofluoride in 60 ml of water was added dropwise to the filtrate under agitation. The precipitated borofluoride was filtered off, cooled with cold water, washed with cold acetonitrile isopropyl ether, and then dried at room temperature under reduced pressure. The amount of the product was 18.3 g in a yield of 90.0%.

800 ml of N,N-dimethylformamide and 4.24 g (0.01 mol) of calix [n] arene were poured into a 1000-ml beaker, and then cooled to 0° C. To the resultant solution was added 2.04 g (0.005 mol) of the borofluoride obtained as described above and then there was slowly added 4.5 g of N-methylmorpholine. After the solution was agitated for 2 hours while maintaining the temperature at 5° C. or less, the solution was further agitated for 1 hour at room temperature. The precipitate was filtered off, purified with N,N-dimethylformamide, washed with water and then dried at room temperature under reduced pressure. The amount of the product was 4.71 g in a yield of 53.0%.

The thus-obtained compound example (1) was subjected to elemental analysis using an elemental analyzer (produced by CARLO ERBA INSTRUMENTS Co., Ltd. EA-1108).

The results obtained are as follows:

| | Calculated value (%) | Measured value (%) |
|---|---|---|
| C | 72.97 | 72.61 |
| H | 3.63 | 3.85 |
| N | 12.61 | 12.33 |

The electrophotographic photosensitive member of the present invention comprises a photosensitive layer containing the azo-calix [n] arene compound and formed on a conductive support. Although the photosensitive layer may comprise a single layer, it is preferably a function separated type comprising a laminate of a charge generating layer containing the azo-calix [n] arene compound and a charge transfer layer containing a charge transfer material.

The charge generating layer can be formed by coating on the conductive support a coating solution prepared by dispersing the azo-calix [n] arene compound in an appropriate solvent together with a binder resin. The thickness of the charge generating layer is 5 μm or less, preferably 0.1 to 1 μm. The content of the azo-calix [n] arene compound is preferably 40 to 85% by weight, more preferably 50 to 80% by weight, based on the total weight of the layer containing the azo-calix [n] arene compound.

The binder resin used for the charge generating layer is selected from a wide range of insulating resins or organic photoconductive polymers. For example, substituted or unsubstituted polyvinylbutyral, polyvinylbenzal, polyacrylate, polycarbonate, polyester, phenoxy resins, cellulose resins, acrylic resins, and polyurethane resins are preferred. As a substituent, a halogen atom, an alkyl group, an alkoxy group, a nitro group, a trifluoromethyl group and a cyano group are preferred.

The solvent used is preferably selected from solvents which dissolve the binder resin and which do not dissolve the charge transfer layer and the undercoat layer, which will be described below. Examples of such solvents include ethers such as tetrahydrofuran, 1,4-dioxane, and the like; ketones such as cyclohexanone, methyl ethyl ketone, and the like; amides such as N,N-dimethylformamide, and the like; esters such as methyl acetate, ethyl acetate, and the like; aromatic hydrocarbon compounds such as toluene, xylene, chlorobenzene, and the like; alcohols such as methanol, ethanol, 2-propanol, and the like; aliphatic hydrocarbon compounds such as chloroform, methylene chloride, and the like.

The charge transfer layer is laminated above or below the charge generating layer. The charge transfer layer is formed by coating a coating solution prepared by dissolving a charge transfer material in a solvent together with an appropriate binder resin according to demand. The thickness of the charge transfer layer is 5 to 40 μm, preferably 10 to 30 μm.

The charge transfer materials include electron transfer materials and hole transfer materials. Examples of electron transfer materials include electron attractive materials such as 2,4,7-trinitrofluorenone, 2,4,5,7-tetranitrofluorenone, chloranil, tetracyanoquinodimethane, and the like; and polymers of these electron attractive materials. Examples of hole transfer materials include polycyclic aromatic compounds such as pyrene, anthracene, and the like; heterocyclic compounds carbazole, indole, imidazole, oxazole, thiazole, oxadiazole, pyrazole, pyrazoline, thiadiazole, and triazole compounds, and the like; hydrazone compounds such as p-diethylaminobenzaldehyde-N,N-diphenylhydrazone, N,N-diphenylhydrazino-3-methylidene-9-ethylcarbazole, and the like; styryl compounds such as α-phenyl-4'-N,N-diphenylaminostilbene, 5-[4-(di-p-tolylamino) benzylidene]-5H-dibenzo [a,b] cycloheptene, and the like; benzidine compounds; triarylmethane compounds; triarylamine compounds such as tri(p-tolyl)amine, 2-[di-(p-tolyl)]-aminobiphenyl, 1-[di-(p-tolyl)]-aminopyrene, and the like; and polymers having main chains or side chains comprising these compounds (for example, poly-N-vinylcarbazole, polyvinylanthracene, and the like).

Besides these organic charge transfer materials, inorganic materials such as selenium, selenium-tellurium, amorphous silicon, cadmium sulfide, and the like can be used. These charge transfer materials can also be used independently or in combination of at least two materials. The content of the charge transfer material is preferably 30 to 70% by weight on the basis of the charge transfer layer.

Examples of the binder resin used for the charge transfer material include insulating resins such as acrylic resins, polyacrylate, polycarbonate, polyester, polystyrene, acrylonitrile-styrene copolymers, polyacrylamide, polyamide, chlorinated rubber, and the like; organic photoconductive polymers such as poly-N-vinylcarbazole, polyvinylanthracene, and the like.

When the photosensitive layer comprises a single layer, the thickness of the photosensitive layer is 5 to 40 μm, preferably 10 to 30 μm.

The single photosensitive layer can be formed by coating on the conductive support a solution prepared by dispersing the azo-calix [n] arene compound in an appropriate solvent, and then drying the coating.

Each of the layers can be coated by a general coating method, e.g., a dip coating method, a spray coating method, a spinner coating method, a roller coating method, a Meyer bar coating method, a blade coating method, or the like.

As the material for the conductive support on which the photosensitive layer is formed, for example, aluminum, an aluminum alloy, copper, zinc, stainless steel, vanadium, molybdenum, chromium, titanium, nickel, indium, gold and platinum are used. Also, a plastic support e.g., polyethylene, polypropylene, polyvinyl chloride, polyethylene terephthalate, acrylic resins, or the like, on which one of those metals or alloys is vacuum-deposited, a support comprising a plastic or metal substrate on which conductive particles, e.g., carbon black, silver particles, or the like, are coated together with an appropriate binder resin, and a plastic support impregnated with conductive particles can be used.

An undercoat layer having a barrier function and an adhesive function can also be provided between the conductive support and the photosensitive layer. The undercoat layer can be formed by using polyvinyl alcohol, nitrocellulose, polyamide (nylon 6, nylon 66, nylon 610, copolymerization nylon, alkoxymethyl nylon, or the like), polyurethane, aluminum oxide or the like. The thickness of the undercoat layer is 5 μm or less, preferably 0.1 to 3 μm.

The azo-calix [n] arene compound used in the present invention may have either an amorphous crystal form or crystalline form. The azo-calix [n] arene compound may be used in a mixture of at least two of the above azo-calix [n] arene compounds, or in combination with a known charge generating material such as phthalocyanine pigment, azo pigment, perylene pigment or the like.

The electrophotographic photosensitive member can broadly be applied to not only printers of an electrophotographic copying machine and a facsimile, but also to a laser beam printer, a CRT printer, a LED printer, a liquid crystal printer, laser process, and the like.

A protective layer may be provided on the photosensitive layer if required. The protective layer can be formed by coating on the photosensitive layer a solution prepared by dissolving in an appropriate solvent a resin such as polyvinyl butyral, polyester, polycarbonate (polycarbonate Z, modified polycarbonate or the like), nylon, polyimide, polyacrylate, polyurethane, a styrene-butadiene copolymer, a styrene-acrylic acid copolymer, a styrene-acrylonitrile copolymer or the like, and then drying the coating. The thickness of the protective layer is preferably 0.05 to 20 μm.

The protective layer may contain conductive particles and an ultraviolet absorber. As the conductive particles, for example, metal oxide particles such as tin oxide particles are preferably used.

An electrophotographic apparatus comprising the electrophotographic photosensitive member of the present invention will be described below.

In FIG. 1, a drum-shaped photosensitive member 1 of the present invention is rotated around the axis 1*a* in the direction of an arrow at a predetermined peripheral speed. The periphery of the photosensitive member 1 is uniformly charged with positive or negative predetermined potential by charging means 2 in the rotation process, and then subjected to image exposure light L (slit exposure or laser beam scanning exposure) by image exposure means, which is not shown in the drawing, in an exposure part 3. As a result, an electrostatic latent image is successively formed on the periphery of the photosensitive member 1 in correspondence with the exposed image. The electrostatic latent image is then developed with a toner by development means 4, and the toner developed image is successively transferred by a corona transfer means 5 to a recording material 9 which is passed between the photosensitive member 1 and the corona transfer means 5 from a feeding unit, which is not shown in the drawing, in synchronism with the rotation of the photosensitive member 1. The recording material 9 to which the image is transferred is separated from the surface of the photosensitive member and introduced into image fixing means 8 for fixing the image to be printed out as a copy to the outside of the apparatus. After the image is transferred, the surface of the photosensitive member 1 is cleaned by a cleaning means 6 for removing the residual toner remaining on the surface, destaticized by a pre-exposure means 7, and then again used for forming an image.

Figure 2:
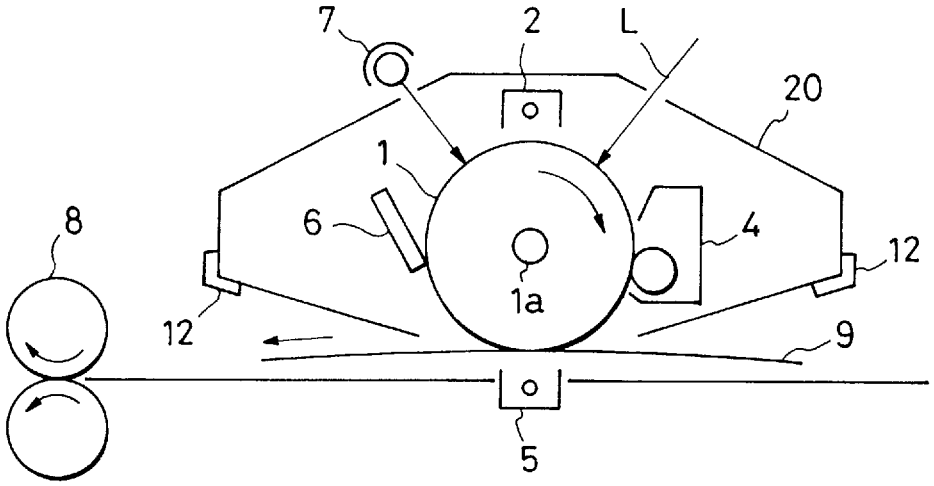
FIG. 2 is a drawing illustrating another example of an electrophotographic apparatus of the present invention.

In the apparatus shown in FIG. 2, at least the photosensitive member 1, the charging means 2 and the development means 4 are contained in a container 20 to produce a process cartridge. The process cartridge is detachably arranged in the apparatus by using guide means 12 such as rails. The cleaning means 6 may be disposed inside the container 20.

Figure 3:
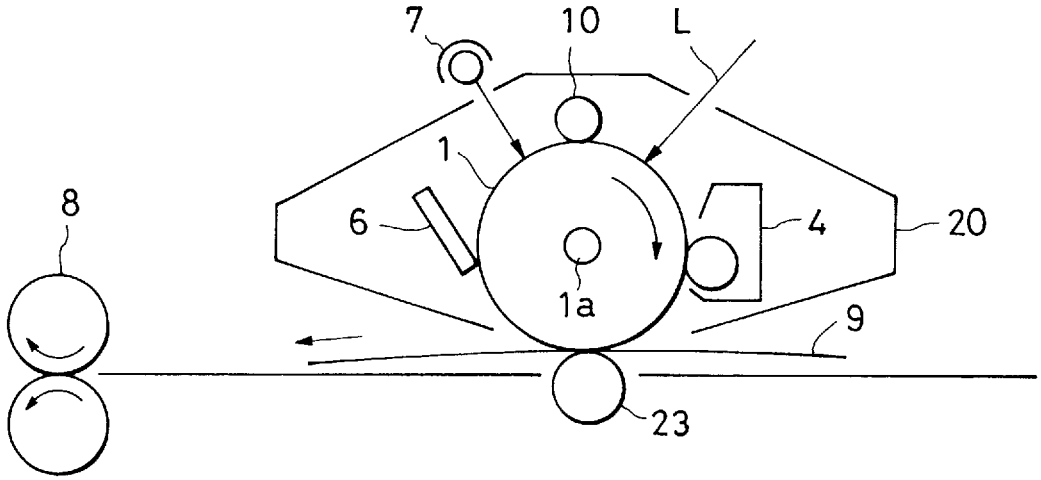
FIG. 3 is a drawing illustrating a further example of an electrophotographic apparatus of the present invention.
Figure 4:
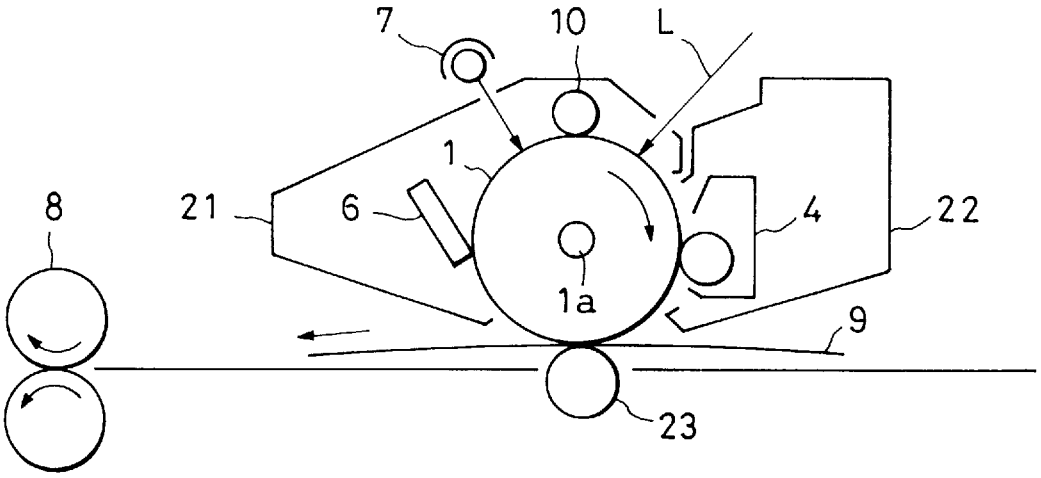
FIG. 4 is a drawing illustrating a further example of an electrophotographic apparatus of the present invention.

Referring to FIGS. 3 and 4, a direct charging member 10 may be used as a charging means so that the photosensitive member 1 is charged by bringing the direct charging member 10 to which a voltage is applied into contact with the photosensitive member 1 (this charging means is referred to as "direct charging" hereinafter). In the apparatus shown in FIGS. 3 and 4, a toner image formed on the photosensitive member 1 is transferred to the recording material 9 by a direct charging member 23. In other words, the direct charging member 23 to which a voltage is applied is brought into contact with the recording material 9 to transfer the toner image formed on the photosensitive member 1 to the recording material 9.

Furthermore, in the apparatus shown in FIG. 4, at least the photosensitive member 1 and the direct charging member 10 are contained in a first container 21 to provide a first process cartridge, and at least the development means 4 is contained in a second container 22 to provide a second process cartridge. These first and second process cartridges are detachably arranged in the apparatus. The cleaning means 6 may be disposed inside the container 21.

When the electrophotographic apparatus is used as a copying machine or a printer, light reflected from an original or transmitted through an original is used as the image exposure light L. Alternatively, exposure is performed by scanning a laser beam, or driving a light-emitting diode array or a liquid crystal array according to the signals generated by reading an original.

The electrophotographic photosensitive member of the present invention has high sensitivity and remarkably stable electric potential properties even in repeated use. When the electrophotographic photosensitive member is provided in a process cartridge and an electrophotographic apparatus, the same excellent properties are exhibited.

EXAMPLES

Examples 1 to 8

On a sheet-formed aluminum support there was coated by a Meyer bar a solution prepared by dissolving 5 g of methoxymethyl nylon (weight average molecular weight 32000) and 10 g of alcohol-soluble copolymerization nylon (weight average molecular weight 29,000) in 95 g. of methanol to form an undercoat layer having a thickness of 1 $\mu$m after drying.

6 g of Compound Example (1) was added to a solution prepared by dissolving 2 g. of butyral resin (degree of butyral groups, 63 mol %) in 95 g. of cyclohexanone, and dispersed by a sand mill for 20 hours. The resultant dispersion was coated on the undercoat layer by a Meyer bar so as to obtain a thickness of 0.2 $\mu$m after drying to form a charge generating layer.

A solution prepared by dissolving 5 g. of hydrazone compound having the following structural formula (4):

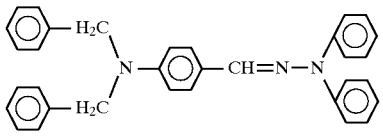

(4)

and 5 g of polymethylmethacrylate (number average molecular weight 100,000) in 40 g. of chlorobenzene was coated on the charge generating layer, and then dried to form a charge transfer layer having a thickness of 16 $\mu$m, to form an electrophotographic photosensitive member of the present invention.

Electrophotographic photosensitive members of Examples 2 to 8 were produced by the same method as Example 1 except that the compound examples shown in Table 1 were used in place of Compound Example (1).

Each of the thus-produced electrophotographic photosensitive members was negatively charged by corona discharge at −5 KV using an electrostatic copying paper testing device (SP-428, produced by Kawaguchi Denki Co., Ltd.). After the photosensitive member was allowed to stand in a dark place for 1 second, the photosensitive member was exposed by using a halogen lamp with an illuminance of 10 lux to evaluate charging properties. The charging properties were evaluated by measuring the surface potential $V_0$ immediately after charging and the exposure $E_{1/2}$required for halving the surface potential after allowing to stand in a dark place for 1 second.

The results obtained are shown in Table 1.

TABLE 1

| Example | Compound Example | $V_0$ (−V) | $E_{1/2}$ (lux · sec) |
|---|---|---|---|
| 1 | (1) | 610 | 2.30 |
| 2 | (5) | 630 | 2.10 |

TABLE 1-continued

| Example | Compound Example | $V_0$ (−V) | $E_{1/2}$ (lux · sec) |
|---|---|---|---|
| 3 | (9) | 620 | 2.30 |
| 4 | (11) | 630 | 2.20 |
| 5 | (14) | 570 | 1.95 |
| 6 | (16) | 620 | 3.00 |
| 7 | (18) | 610 | 3.20 |
| 8 | (24) | 630 | 2.32 |

Comparative Examples 1 and 2

Electrophotographic photosensitive members were produced by the same method as Example 1 except that the comparative pigments 1 and 2 below were used in place of Compound Example (1) used in Example 1, and the charging properties of each of the electrophotographic photosensitive members were evaluated in the same manner as Example 1. The results obtained are shown in Table 2.

Comparative Pigment 1

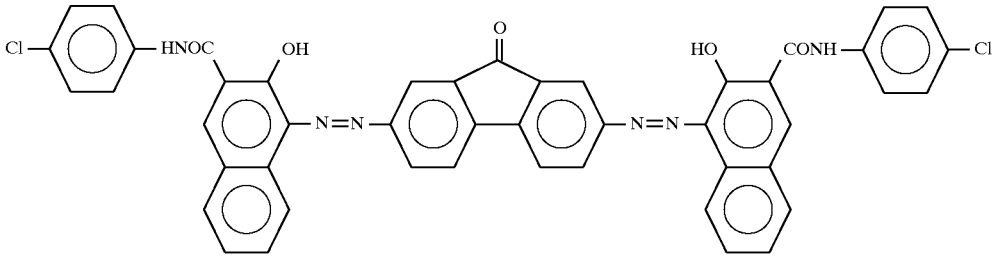

Comparative Pigment 2

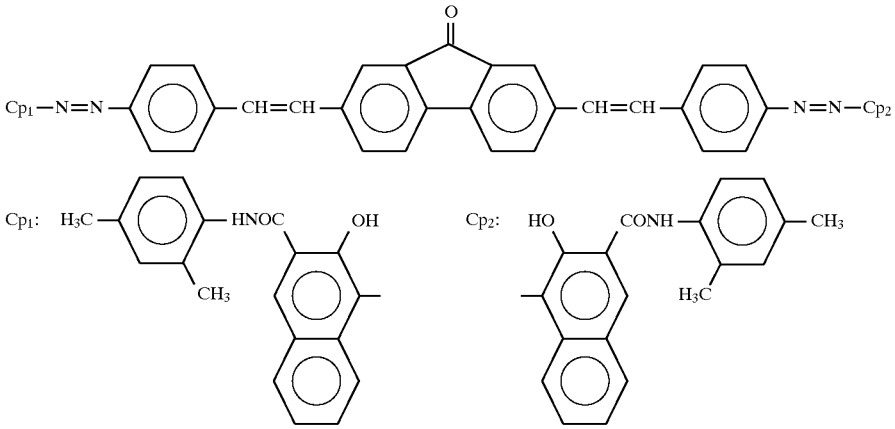

TABLE 2

| Comparative Example | Comparative Pigment | $V_0$ (−V) | $E_{1/2}$ (lux · sec) |
|---|---|---|---|
| 1 | 1 | 550 | 3.55 |
| 2 | 2 | 450 | 7.35 |

The results indicate that all the electrophotographic photosensitive members of the present invention have sufficient chargeability and excellent sensitivity properties.

Examples 9 to 13

The electrophotographic photosensitive member produced in Example 1 was attached to the cylinder of the electrophotographic copying machine shown in FIG. 2, and a voltage of −7.0 KV was applied to the corona charger. After the initial dark potential $V_D$ and light potential $V_L$ were set to about −700 V and −200 V, respectively, the cycle of charging, exposure and destaticization was repeated 5000 times. Durability properties were evaluated by measuring a variation $\Delta V_D$ in the dark potential and a variation $\Delta V_L$ in the light potential after repeated use. The results obtained are shown in Table 3. In the variations in potential, the minus sign indicates a decrease in the absolute value of potential, and the plus sign indicates an increase in the absolute value of potential.

The electrophotographic photosensitive members produced in Examples 2, 3, 5 and 8 were evaluated in the same manner. The results obtained are shown in Table 3.

TABLE 3

| Example | Compound Example | $V_D$ (V) | $V_L$ (V) |
|---|---|---|---|
| 9 | (1) | 0 | +5 |
| 10 | (5) | +5 | +10 |
| 11 | (9) | −5 | +5 |
| 12 | (14) | −10 | 0 |
| 13 | (24) | +5 | −5 |

Comparative Examples 3 and 4

Each of the electrophotographic photosensitive members produced in Comparative Examples 1 and 2 was repeatedly used to measure a variation in potential by the same method as in Examples 9 to 13. The results obtained in Table 4.

TABLE 4

| Comparative Example | Comparative Pigment | $V_D$ (V) | $V_L$ (V) |
|---|---|---|---|
| 3 | 1 | −50 | +30 |
| 4 | 2 | −80 | +50 |

The results of Examples 9 to 13 and Comparative Examples 3 and 4 reveal that the electrophotographic photosensitive member of the present invention causes less variation in potential during repeated use.

Example 14

On a sheet-formed aluminum support was deposited an undercoat layer of polyvinyl alcohol having a thickness of 0.5 μm.

A dispersion of the same Compound Example (18) as that used in Example 7 was coated on the undercoat layer by a Meyer bar, and then dried to form a charge generating layer of 0.2 μm thick.

A solution prepared by dissolving 5 g. of compound having the following structural formula (5):

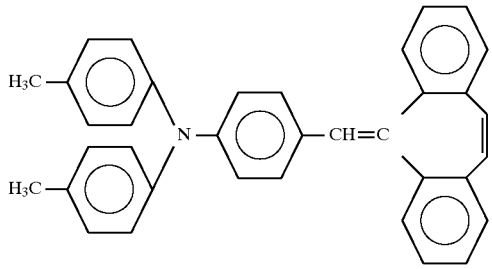

(5)

and 5 g. of polycarbonate (weight average molecular weight 55000) in 40 g. of tetrahydrofuran was coated on the charge generating layer and then dried to form a charge transfer layer of 16 μm thick to produce an electrophotographic photosensitive member of the present invention.

The sensitivity of the thus-produced electrophotographic photosensitive member was measured by the following method:

The electrophotographic photosensitive member was attached to the cylinder of a laser beam printer (trade name LBP-SX, produced by Canon Inc.) in which direct charging is performed, and then charged so that the dark potential was −700 V. The electrophotographic photosensitive member was then irradiated with a laser beam with a wavelength of 802 μm to measure the quantity of light required for reducing a potential of −700 V to −150 V in order to evaluate the sensitivity.

With a dark potential and a light potential set to −700 V and −150 V, respectively, a durability test was carried out by passing 4000 sheets to measure a variation $\Delta V_D$ in the dark potential and a variation $\Delta V_L$ in the light potential. The sensitivity and the results of measurement of the variations in potential were as follows:

Sensitivity; 1.25 μJ/cm2

$\Delta V_D$: 0V $\Delta V_L$: +5 V

Example 15

On a sheet-formed aluminum support was deposited an undercoat layer of polyvinyl alcohol having a thickness of 0.5 μm.

A dispersion of the same Compound Example (14) as that used in Example 5 was coated on the undercoat layer by a Meyer bar, and then dried to form a charge generating layer of 0.2 μm thick.

A solution prepared by dissolving 5 g. of compound having the following structural formula (6):

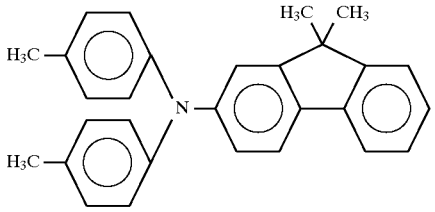

(6)

and 5 g of polycarbonate (weight average molecular weight 55000) in 40 g of tetrahydrofuran was coated on the charge generating layer and then dried to form a charge transfer layer of 17 μm thick to produce an electrophotographic photosensitive member of the present invention.

The sensitivity and variations in potential in a durability test of the thus-produced electrophotographic photosensitive member was measured by the same method as Example 14. The results of measurement were as follows:

Sensitivity; 1.10 μJ/cm$^2$ $\Delta V_D$: 0 V $\Delta V_L$: +5 V

Example 16

An electrophotographic photosensitive member of the present invention was produced by the same method as Example 5 except that the charge generating layer and the charge transfer layer were laminated in the reverse order. Charging properties were evaluated by the same method as Example 1 except that the photosensitive member was positively charged. The results obtained were as follows:

$V_0$: +620 V $E_{1/2}$: 2.75 lux·sec

Example 17

An undercoat layer and a charge generating layer were formed by the same method as Example 5. On the charge generating layer was coated by a Meyer bar a solution prepared by dissolving 5 g. of 2,4,7-trinitro-9-fluorenone and 5 g of poly-4,4-dioxydiphenyl-2,2-propanecarbonate (weight average molecular weight 300,000) in 50 g. of tetrahydrofuran, and then dried to form a charge transfer layer having a thickness of 16 μm to produce an electrophotographic photosensitive member. Charging properties were evaluated by the same method as Example 1 except that the photosensitive member was positively charged. The results obtained were as follows:

$V_0$: +650 V $E_{1/2}$: 2.50 lux·sec

Example 18

0.5 g. of Compound Example (2) was added to 9.5 g of cyclohexane and then dispersed by using a paint shaker for 5 hours. To the resultant dispersion was added a solution prepared by dissolving 5 g of the same charge transfer material as that used in Example 1 and 5 g. of polycarbonate in 40 g of tetrahydrofuran, followed by shaking for 1 hour. The thus-prepared coating solution was coated on an aluminum substrate by a Meyer bar and then dried to form a photosensitive layer of 20 μm thick to produce an electrophotographic photosensitive member of the present invention. Charging properties were evaluated by the same method as Example 1 except that the photosensitive member was positively charged. The results obtained were as follows:

$V_0$: +640 V $E_{1/2}$: 2.20 lux·sec

What is claimed is:

1. An electrophotographic photosensitive member comprising: a photosensitive layer formed on a support, wherein the photosensitive layer contains an azo-calix [n] arene compound produced by coupling of a calix [n] arene compound and an azonium compound having at least two azo groups.

2. An electrophotographic photosensitive member according to claim 1, wherein the calix [n] arene compound and the azonium compound are represented by the following formulas (1) and (2), respectively:

(1)

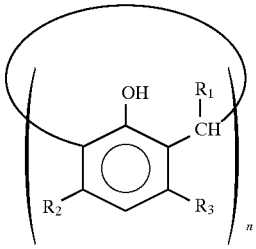

wherein $R_1$, $R_2$ and $R_3$ are each a hydrogen atom or an alkyl group, and n is an integer of 4 to 8, $$Ar-(N_2 \cdot X)_m \quad (2)$$

wherein X is $BF_4$, $ZnCl_2$ or a halogen atom, Ar is an aromatic hydrocarbon ring which is substituted or unsubstituted, a heterocyclic ring which is substituted or unsubstituted, or combination of a plurality of aromatic hydrocarbon rings or heterocyclic rings, and m is an integer of 2 to 4.

3. An electrophotographic photosensitive member according to claim 1, wherein the azo-calix [n] arene compound is represented by the following formula (3):

(3)

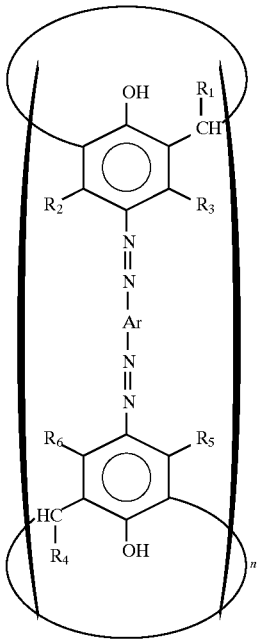

wherein $R_1$ to $R_6$ are each a hydrogen atom or an alkyl group, and n is an integer of 4 to 8.

4. An electrophotographic photosensitive member according to claim 1, wherein the content of the azo-calix [n] arene compound is 40 to 85% by weight based on the total weight of the layer containing the azo-calix [n] arene compound.

5. An electrophotographic photosensitive member according to claim 4, wherein the content of the azo-calix [n] arene compound is 50 to 80% by weight.

6. An electrophotographic photosensitive member according to claim 1, wherein the photosensitive layer comprises a laminate of at least a charge generating layer and a charge transfer layer, wherein the charge generating layer contains the azo-calix [n] arene compound.

7. An electrophotographic photosensitive member according to claim 1, wherein the photosensitive layer comprises a single layer.

8. An electrophotographic apparatus comprising:

an electrophotographic photosensitive member according to claim 1;

a charging means for charging the electrophotographic photosensitive member;

an image exposure means for effecting image-exposure to the charge electrophotographic photosensitive member to form an electrostatic latent image; and a development means for developing the electrostatic latent image formed on the electrophotographic photosensitive member with a toner.

9. An electrophotographic apparatus according to claim 8, wherein the charging means comprises a direct charging member.

10. A process cartridge comprising an electrophotographic photosensitive member according to claim 1, and a charging member for charging the electrophotographic photosensitive member.

11. A process cartridge according to claim 10, which further comprises a development means for developing an electrostatic latent image on the electrophotographic photosensitive member.

* * * * *